US005959826A

United States Patent [19]

Baurand et al.

[11] Patent Number: 5,959,826

[45] Date of Patent: Sep. 28, 1999

[54] CONTROL DEVICE FOR AN ELECTROMECHANICAL CONTACTOR-CIRCUIT BREAKER TYPE DEVICE WITH SEPARABLE POWER CONTACTS

[75] Inventors: Gilles Baurand, Montesson La Borde; Jean-Christophe Cuny, Rueil Malmaison; Alain Gousset, Nanterre; Philippe Guibert, Chatou, all of France

[73] Assignee: Schneider Electric SA, Boulogne Billancourt, France

[21] Appl. No.: 09/177,554

[22] Filed: Oct. 23, 1998

[30] Foreign Application Priority Data

Oct. 24, 1997 [FR] France ..... 97 13478

[51] Int. Cl.[6] ..... H01H 47/02

[52] U.S. Cl. ..... 361/156; 361/170; 361/115

[58] Field of Search ..... 361/88–93, 115, 361/152, 156, 170, 187, 189; 307/112–113, 115–116, 110, 64–66, 44, 43, 48

[56] References Cited

U.S. PATENT DOCUMENTS

| | | | |
|---|---|---|---|
| 3,549,955 | 12/1970 | Paine | 361/155 |
| 4,025,821 | 5/1977 | Lang | 361/111 |
| 4,602,309 | 7/1986 | Gaude | 361/210 |
| 4,926,282 | 5/1990 | McGhie | 361/102 |
| 5,657,194 | 8/1997 | Waltz | 361/75 |

FOREIGN PATENT DOCUMENTS

| | | |
|---|---|---|
| 2 498 807 | 7/1982 | France . |
| 2 183 400 | 6/1987 | United Kingdom . |

*Primary Examiner*—Jeffrey Gaffin
*Assistant Examiner*—Kim Huynh
*Attorney, Agent, or Firm*—Oblon, Spivak, McClelland, Maier & Neustadt, P.C.

[57] ABSTRACT

A control device for an electromechanical circuit breaker device. The device includes a bistable type electromagnet to deliberately control power contacts and a monostable trip electromagnet to open the contacts in case of a fault. The bistable electromagnetic coil and the trip electromagnetic coil are placed in parallel with a capacitance. The control device includes a maintained control switch and an H bridge of two-way switches associated with the bistable coil. The control device acts on the bridge of switches and a trip switch opens the contacts depending on the current in the coils measured by sensors.

6 Claims, 1 Drawing Sheet

CONTROL DEVICE FOR AN ELECTROMECHANICAL CONTACTOR-CIRCUIT BREAKER TYPE DEVICE WITH SEPARABLE POWER CONTACTS

This invention relates to a control device for an electromechanical contactor-circuit breaker type device with separable power contacts comprising an electromagnet fitted with a control coil for deliberately opening and closing the contacts, an electromagnet with a trip coil for opening contacts in the case of an electrical fault, and a power source for the coils.

It is well known that an electromechanical contactor device requires a substantial current consumption when its control electromagnet has to close its contacts; however, the current consumption may be minimized when the contacts remain in the closed state.

It is also desirable that the power supply and control of the control coil and the trip coil of an electromechanical contactor-circuit breaker device should be as simple as possible.

The purpose of the invention is to minimize the consumption of a control device for an electromechanical contactor-circuit breaker device while simplifying the manufacture of this device.

According to the invention, the deliberate control electromagnet is of the bistable type and the trip electromagnet is of the monostable type; an H-bridge of 2-way switches is associated with the control coil and a trip switch is placed in series with the trip coil; the energy source for the closing control coil is an external voltage source, whereas the energy source for the opening control coil and the trip coil consists of a capacitance mounted in parallel to the coils.

Preferably, a control circuit acts firstly on the bridge two-way switches to pass a switching current through the control coil in the forward or reverse direction, and secondly on the trip switch as a function of the current measured by sensors associated with the control coil and the trip coil respectively.

It is advantageous if the control circuit sequentially controls the two-way switches and the trip switch, in order to discharge the capacitance into the trip coil in priority if there is a fault.

In one embodiment with very good safety, a normal opening capacitance is installed in parallel with the control coil and its switches bridge, and an "open on fault" capacitance is installed in parallel with the trip coil; the trip coil is connected firstly to the positive poles of the bridge and of the normal opening capacitance through a first diode, and secondly to the positive pole of the "open on fault" capacitance through a second diode, the diodes being installed in opposition with the common point of their cathodes connected to the trip coil.

Advantageously, current sensors are resistances connected to the two-way switch bridge and to the trip switch, so that only a single control circuit input is used.

The description of a non-restrictive embodiment of the invention will be given below with respect to the drawings in the appendix.

Figure 1:
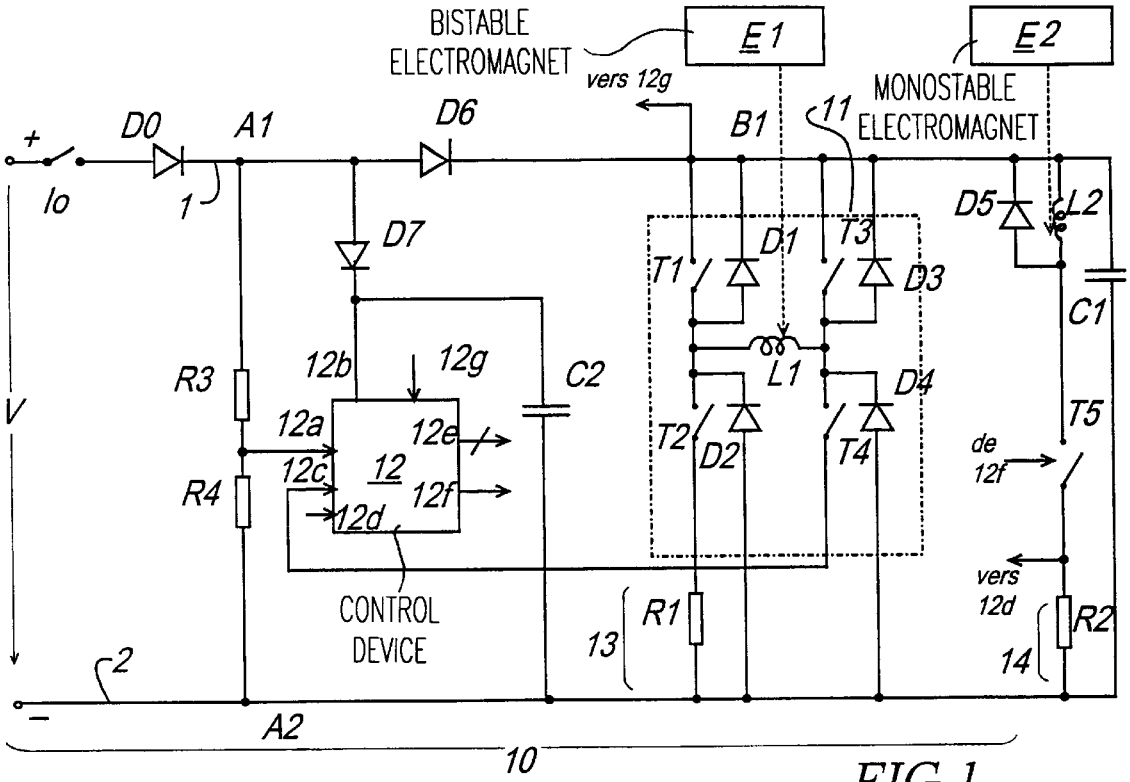
FIG. 1 is a diagram of the control device according to the invention.

The device in FIG. 1 is designed to control an electromechanical contactor-circuit breaker device with separable power contacts. To deliberately close and open the contacts, the device comprises a bistable type electromagnet E1 equipped with a coil L1 and a mobile armature not shown, which is held in the two stable end positions by permanent magnets; the device also comprises a monostable trip electromagnet E2, for which coil L2 is shown and which cooperates with an opening mechanism not shown, to quickly open contacts in the case of an electrical fault on at least one of the power lines controlled by the contacts. The electromagnet E1 is switched to one or the other of its stable states by current passing in either direction through coil L1.

The control device 10 is powered from an external DC or rectified AC power supply source with voltage V through two conductors 1, 2 with high and low potentials respectively through an on/off switch $I_0$ with continuous control; there is a non-return diode $D_0$ on the high conductor 1, and optionally (see FIG. 2) a voltage adaptation and consumption limitation device 3; coils L1, L2 and a switching capacitance C1 are laid out in parallel between conductors 1, 2. Device 3 avoids current peaks and provides a minimum capacitance charging time.

To control current circulation in coil L1, the device comprises an H bridge 11 of electronic switches associated with coil L1. it also comprises a control circuit 12 that is energized from voltage V and which controls firstly switches T1–T4 in bridge 11, and secondly a switch T5 placed in series with coil L2. For example, switches T1–T4 may be transistors placed in series with the coil L1 such that a current from the voltage source passes through L1 through conductors 1, 2 in one direction when the transistors T1, T4 are conducting and transistors T3, T2 are blocked, and in the other direction when T1, T4 are blocked and T3, T2 are conducting. Recovery diodes D1–D4 are associated with switches T1–T4 respectively, and switch T5 is associated with the recovery diode D5. The bridge 11 may be integrated in circuit 12.

A current sensor 13 is provided to measure the current passing through the coil L1 of the bistable electromagnet. This sensor may be composed of a judiciously positioned resistance; thus the negative pole of bottom switches on bridge 11 may for example be connected to a terminal of resistance R1, and to an input 12*c* of control circuit 12, whereas the other terminal of resistance R1 is connected to the negative pole of the power supply voltage and consequently to the anodes of diodes D2, D4. A current sensor 14 is placed in series with the trip coil L2; this coil may even be a resistance R2 measuring the current in the trip coil, this resistance being connected to an input to the control circuit 12.

The control circuit 12 is connected through a connection 12a to the mid-point of a voltage divider R3, R4 placed between conductors 1, 2, to immediately take account of the presence of a voltage above a certain threshold or a voltage drop below a certain threshold, and is powered through a connection 12*b* by means of capacitance C2 located between conductors 1, 2 and connected to conductor 1 through diode D7. The circuit 12 is connected through an input 12*c* to the current sensor 13, through an input 12*d* to the current sensor 14 and through outputs 12*e*, 12*f* to control inputs of transistors T1–T4, and transistor T5 respectively. An additional connection 12*g* connected to the positive pole of bridge 11 or capacitance C1 detects a charge in the capacitance. The control circuit may test the charging slope of capacitance C1 to determine if it is operational.

Figure 3:
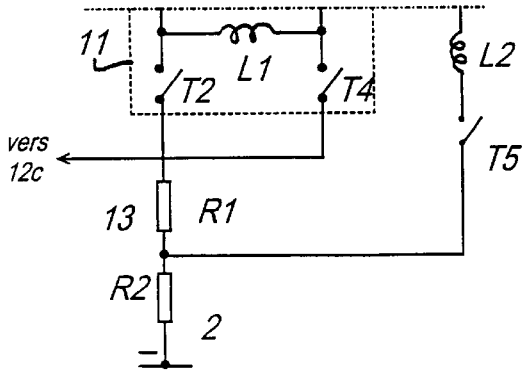
FIG. 3 shows a detail of a variant.

In the preferred embodiment shown in FIG. 3, the negative pole of the measurement resistance R1 is connected firstly to the trip switch T5, and secondly to the negative conductor 2 through the measurement resistance R2; similarly, the link with input 12*d* of the control circuit 12 may be eliminated and all that is necessary is to use a single input 12*c* of the control circuit to enable detection of current passing in the two coils.

The described device operates as follows.

When the on/off switch $I_0$ is closed at time an initial time the capacitance C1 charges starting from the external source A through a limiting resistance or another current limiting device specific to device 3, and the same occurs for C2; the control circuit 12 is activated at time a first time when it observes that the potential between A1 and A2 is greater than the initial determined threshold V1 and that C1 is charged. The control circuit then closes T1 and T4, and then carries our a controlled series of openings and closings of T1, to circulate the required energy in the forwards direction in coil L1 by means of current pulses; when T1 is closed, the current passes in T1, L1, T4 and R1; when T1 is open, the current passes through L1, T4, R1, D2. The discharge of Cl during T1 open phases does not affect C2 due to the presence of diode D7. At time a second time determined by circuit 12, circuit 12 puts transistors T1–T4 at rest; due to its bistable nature, the electromagnet remains in its closed state, and the power contacts remain closed, as long as the on/off switch $I_0$ remains closed.

Since coil L1 does not need any hold current, it is only necessary to simply compensate losses and continue operation of the control circuit; if device 3 is provided, it limits the level of the power supply current.

The power contacts can be opened deliberately by opening the on/off switch $I_0$ at time a third time the control circuit 12 detects when the power supply voltage drops below a threshold V3 on its connection 12*a*, while continuing to be powered by capacitance C2. Circuit 12 opens switches T1 and T4, and closes switches T2 and T3 continuously or in a modulated manner. The current output from capacitance C1 thus passes through coil L1 in the reverse direction, the armature of coil L1 changes position and the result is that the power contacts are opened. The value of capacitance C1 is such that it discharges more quickly than C2 so that the control circuit remains operational until the contacts open. When the voltage drops once again below a minimum threshold V4, circuit 12 blocks switches T2 and T3 at time a fourth time.

When an electrical fault such as an overcurrent is observed by a current sensor associated with the power circuit, the control circuit 12 receives a corresponding signal on its input 12*c*; consequently, it leaves switches T1–T4 at rest and makes transistor T5 conducting such that the current in capacitance C1 passes through coil L2 that activates the opening mechanism. Circuit 20 then makes transistors T2–T3 conducting to pass a current in coil L1 capable of putting the control electromagnet into a state confirming that contacts are open; in this phase, transistor T5 may be blocked to check the discharge level of capacitance C1. The same opening sequence may be initiated in response to a lack of current in coil L1 following closure of switch $I_0$.

Figure 2:
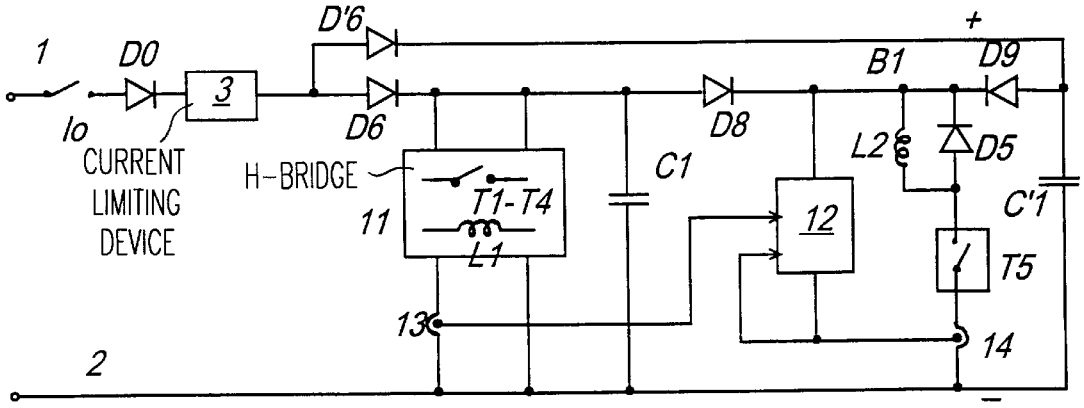
FIG. 2 shows a variant embodiment of the device.

In the embodiment shown in FIG. 2, the voltage V is applied firstly to the H bridge 10 and the capacitance C1 through diode D6, and secondly to an additional capacitance C'1 through a diode D'6. Therefore capacitances C1 and C'1 are charged through the resistance of device 3 and through diodes D6 and D'6 respectively. The positive terminals of capacitances C1, C'1 are connected to the high terminal of the trip coil L2 through two diodes D8, D9 in opposition, in which the common point of the cathodes is denoted by B1. The low potential point of the opening branch L2, T5, R2 is denoted B2. The control circuit 12 is located between B1 and B2. This device has the advantage that it can remedy the risks of a malfunction if there is a failure in either capacitance.

Thus, when it is required to switch the device to open the contacts, if capacitance C1 is opened, the control circuit 12 detects that there is no current in coil L1 and resistance R1, and consequently makes T5 conducting; capacitance C'1 discharges through diode D9 into the trip coil L2 to open the contacts. If the capacitance C'1 is open and a fault (for example a short circuit) occurs in the power circuit, capacitance C1 replaces C'1 through diode D8 to power coil L2 and open the contacts. If the capacitance C'1 goes into short circuit while the device is in operation, diode D8, D9 mounted in opposition isolate the short circuited capacitance from capacitance C1 which can then power coil L2 with the necessary power as soon as T5 closes. Note that the control circuit 12 connected to point B1 sees the largest of the voltages available on the terminals of C1 and C'1.

We claims:

1. Control device for an electromechanical contactor-circuit breaker device with separable power contacts comprising firstly an electromagnet equipped with a control coil for deliberately opening and closing contacts, and secondly an electromagnet with a trip coil that opens the contacts if a fault occurs, and an energy source for the coils, wherein the control device is characterized in that:

the deliberate control electromagnet is of the bistable type and the trip electromagnet is of the monostable type, a bridge of two-way switches is associated with the control coil and a switch is placed in series with the trip coil, the energy source of the closing control coil is an external voltage source, whereas the energy source for the opening control coil and the trip coil consists of a capacitance installed in parallel with the control coil and the trip coil.

2. Device according to claim 1, characterized in that:

a control circuit acts firstly on the two-way switches of the bridge to circulate a switching current in the control coil in either direction, and secondly a trip switch as a function of the current measured by sensors associated with the control coil and the trip coil respectively;

the control circuit controls the two-way switches and the trip switch sequentially, so that in the case of a fault, a priority discharge will take place from capacitance into the trip coil.

3. Device according to claim 1, characterized in that a normally opening capacitance is mounted in parallel to the control coil and to its bridge of two-way switches, a fault opening capacitance is installed in parallel to the trip coil, the trip coil being connected firstly to the positive poles of the bridge and the normal opening capacitance through a first diode and secondly to the positive pole of the fault opening capacitance through a second diode, the diodes being mounted in opposition with the common point of their cathodes connected to the trip coil.

4. Device according to claim 1, characterized in that the current sensors are laid out as a resistance bridge connected firstly to the two-way switches bridge and to the trip switch, and secondly to a single input of the control circuit.

5. Device according to claim 1, characterized in that the control circuit is capable of controlling two-way switches through modulated pulses.

6. Device according to claim 1, characterized in that the control circuit comprises a consumption reduction device.

* * * * *